US006672573B2

(12) United States Patent
Berton

(10) Patent No.: US 6,672,573 B2
(45) Date of Patent: Jan. 6, 2004

(54) DISPLACEMENT AMPLIFICATION METHOD AND APPARATUS FOR PASSIVE ENERGY DISSIPATION IN SEISMIC APPLICATIONS

(76) Inventor: Stefano Berton, 2222 Sycamore La., Apt. 39, Davis, CA (US) 95616-5507

( * ) Notice: Subject to any disclaimer, the term of this patent is extended or adjusted under 35 U.S.C. 154(b) by 203 days.

(21) Appl. No.: 09/882,937

(22) Filed: Jun. 15, 2001

(65) Prior Publication Data

US 2001/0054785 A1 Dec. 27, 2001

Related U.S. Application Data

(60) Provisional application No. 60/212,437, filed on Jun. 16, 2000.

(51) Int. Cl.[7] ..... E04H 9/02; E04B 1/98

(52) U.S. Cl. ..... 267/136; 52/167.3

(58) Field of Search ..... 188/378–381; 267/136; 248/636–638, 550; 52/167.1–167.9

(56) References Cited

U.S. PATENT DOCUMENTS

| | | | | |
|---|---|---|---|---|
| 3,691,712 A | | 9/1972 | Bowling et al. | |
| 4,409,765 A | | 10/1983 | Pall | |
| 4,687,174 A | | 8/1987 | Helary et al. | |
| 4,910,929 A | | 3/1990 | Scholl | |
| 5,065,552 A | | 11/1991 | Kobori et al. | |
| 5,491,938 A | | 2/1996 | Niwa et al. | |
| 5,533,307 A | | 7/1996 | Tsai et al. | |
| 5,727,663 A | | 3/1998 | Taylor | |
| 5,819,484 A | | 10/1998 | Kar | |
| 5,845,438 A | | 12/1998 | Haskell | |
| 5,915,676 A | | 6/1999 | Abiru et al. | |
| 5,934,028 A | | 8/1999 | Taylor | |
| 6,098,969 A | * | 8/2000 | Nagarajaiah | 267/136 |
| 6,125,596 A | * | 10/2000 | Goto | 52/167.4 |
| 6,233,884 B1 | | 5/2001 | Tipping et al. | |
| 6,247,275 B1 | * | 6/2001 | Taylor | 52/167.3 |
| 6,438,905 B2 | * | 8/2002 | Constantinou | 52/167.3 |

FOREIGN PATENT DOCUMENTS

| | | |
|---|---|---|
| DE | 2 249 259 | 4/1974 |
| JP | 2 261 171 | 10/1990 |

OTHER PUBLICATIONS

Constantinou, Michael C.; Tsopelas, Panos; Hammel, Wilhelm; and Sigaher, Ani N.; "Toggle–Brace–Damper Seismic Energy Dissipation Systems," Feb., 2001, Journal of Structural Engineering, pp. 105–112.

* cited by examiner

*Primary Examiner*—Christopher P. Schwartz
(74) *Attorney, Agent, or Firm*—John P. O'Banion

(57) ABSTRACT

An apparatus and method of dissipating inter floor seismic energy within buildings and other large structures which are subject mechanical deformation in response to seismic activity, wind shear, vibration, and so forth. The present invention provides displacement amplification methods and apparatus which increase the dissipation of seismic energy that is coupled from the building under deformation to a seismic damper. By way of example, the displacement amplifier is exemplified in a number of embodiments that utilize mechanical lever arms, gear sets, and combination amplifier/dampers to amplify energy dissipation.

49 Claims, 21 Drawing Sheets

DISPLACEMENT AMPLIFICATION METHOD AND APPARATUS FOR PASSIVE ENERGY DISSIPATION IN SEISMIC APPLICATIONS

CROSS-REFERENCE TO RELATED APPLICATIONS

This application claims priority to U.S. provisional application serial No. 60/212,437 filed on Jun. 16, 2000, incorporated herein by reference.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains to passive energy dissipation systems in seismic applications, and more particularly to a method and apparatus for amplifying structural displacements for the driving of passive energy dampers.

2. Description of the Background Art

The use of damping devices on a structure to improve performance under shock, wind stress, vibration and so forth, is well known. Damping devices are typically connected to a rigid structure to receive the energy from the mechanical displacements to which the flexible building structure is subjected. The building is often referred to as a gravity frame and the rigid structure is often referred to as a reaction frame. A conventional damper for use in civil structures may be implemented with a large bore damper acting at very low pressure to minimize the rise time effects. However, this solution is often inefficient or impractical in that the damper can be difficult to package due to its large envelope, coupled with a high cost.

The use of less compressible fluid in the damper can reduce the size of a given damper yet these low compressibility fluids are not always practical as they are often toxic, flammable, or have less than favorable temperature characteristics or longevity.

Another attempt at improving the practicality of these seismic isolator makes use of a mechanism that combines a substantially braced column with a horizontal driving arm connected to the column and upper floor with hinge pins. An example of this mechanism being characterized by the "DREAMY" system described in the paper by Taylor, Douglas P. et al., Development and Testing of an Improved Fluid Damper Configuration for Structures Having High Rigidity, Taylor Devices, Inc., that can be found at www.taylordevices.com/techpaper2000.htm. In this configuration, vertically oriented dampers are connected at each end of the driving arm between the driver arm and the lower floor. Use of a lever in this manner increases the effective damper stroke, however, it may not be suitable for use in buildings or bridges because the entire mechanism is required to be extremely rigid to prevent the mechanism from flexing on the same level as the rise deflection of a direct acting damper, thus gaining no design improvement. In addition, utilizing a rigid mechanism necessitates hinge points that have very tight tolerances, while the mechanical links need to be large and heavy to prevent flexing under load. It will be appreciated that the external pin of the lever has to be free to move vertically to prevent the system from being locked in position. Furthermore, the close-fitting hinge points which allow in-plane response must not bind in the out-of-plane direction, and this requirement can readily drive up implementation costs.

Toggle braces have been developed to address certain limitations with lever-type damping mechanisms. Taylor et al., as well as U.S. Pat. No. 5,934,028 describe an approach that uses a toggle as a diagonal brace, with one end of the damper installed proximate the toggle pivot, and the opposite end attached to the building frame. With this approach, a relatively small lateral deflection in the building frame will cause a much larger deflection at the damper, due to the toggle mechanism multiplying deflections at the damper mounting point.

Therefore a need exists for an apparatus and method of increasing the amount of displacement energy which may be dissipated within a damper assembly of a given size, while not increasing implementation cost or reliability. The present invention satisfies those needs, as well as others, and overcomes the deficiencies with previously developed solutions.

BRIEF SUMMARY OF THE INVENTION

The present invention generally comprises a displacement amplification mechanism which is capable of increasing the seismic energy dissipation of buildings and other similar flexible civil structures which are subject to displacement. Embodiments are described, by way of example, which utilize simple lever systems with arms of different lengths or with two concentric connected gears with different radius pinned at the center. The displacement amplifying apparatus of the invention is configured for use within a seismic isolator configured for attachment between a rigid structure and a flexible structure to dissipate seismic energy. It will be appreciated that the flexible structure, such as a civil structure, is often referred to as a gravity frame which under seismic, wind, vibration or other loading conditions becomes physically displaced and distorted. To provide seismic isolation, the energy from the movement of the gravity frame is dissipated in relation to a rigid reaction frame which typically comprises a rigid structure, such as an "A"-frame structure beneath the gravity frame. The reaction frame is typically not subject to the same inter story displacement forces as the gravity frame, but is utilized to extend a rigid base against which the energy may be dissipated. Seismic isolation is provided by the present invention by registering the motion associated with said inter story displacement which is amplified by the displacement amplifying apparatus whose output is received by a damping assembly. The inter story displacement applied to the damper will be amplified by the ratio of the length of the longer arm of the pivoting lever to that of the shorter arm, or by the ratio of diameter of the larger gear to the diameter of the smaller gear. In this way, the effective damper stroke is increased while, at the same time, the required amount of applied force at the damper mounting points is reduced. The invention can be used to amplify the relative inter story displacement that occurs during an earthquake in civil structures, and the resultant amplified displacement can then be used to dissipate energy by means of energy displacement devices such as a fluid viscous dampers (hydraulic dampers), friction dampers, viscous elastic dampers, and so forth.

In addition to amplifying structural displacements, the invention can provide altering the direction of the displacement, which can be beneficial in many situations, such as for meeting selected design constraints or in seismically retrofitting bridges. Furthermore, the invention allows for the use of viscous fluid dampers where the exponent of the damping coefficient is less than one, wherein damping efficiency is increased and more energy may be dissipated.

Additionally, damper beams could be constructed as integral units containing girders, displacement amplification devices according to the present invention, and dampers. These damper beams can be constructed and tested prior to installation into the structure. Further, "super dampers" can be constructed using a plurality of displacement amplification devices integrated with one or more dampers according to the invention for significantly improving the energy dissipation capacity of a small damper. Utilization of a plurality of "super-damper" devices rather than a few high-capacity dampers can provide cost-effective improvements of the seismic response of a structure. It will be appreciated that lever type and geared type amplification mechanisms may be mixed or interchanged to provide the desired seismic isolation. In accordance with a further aspect of the invention, a "turbo damper" can be constructed where, instead of amplifying the displacement and transferring the amplified displacement to a damper, the displacement is converted into rotational energy. The "turbo damper" is a rotating damper that integrates the functions of the mechanical displacement amplifier and the energy damper. The motion received by the "turbo damper" is converted to a rapid rotation of a propeller retained within a housing filled with viscous fluid.

Conventional seismic isolators such as the DREAMY system require the utilization of large components and are subject to possible problems with out-of-phase motion. A problem that is not present in the DREAMY system but exists in other systems is that the external pin of the lever has to be free to move vertically to prevent the system from being locked in position. In contrast, the present invention allows for the use of very short lever arms which are more rigid from a flexural point of view. Out of plane deformation can be solved by employing shear key plates. The last problem of allowing the vertical movement of the pin is solved within the present invention by utilizing flexible coupling point whose motion is constrained, this is exemplified by utilizing an elongated hole in the lever plate into which a coupling pin is retained. This pin-lever connection has the added benefit of allowing relative movement in the out-of-plane direction. The amount of movement being allowed being controlled by the configuration of the shear key plates. These features allow the present displacement amplification apparatus to be beneficially employed for dissipating seismic deformations and wind induced vibrations within large buildings and other structures.

An object of the invention is to increase energy dissipation within seismic isolators for use within civil structures and other large flexible structures.

Another object of the invention is to amplify the displacement of gravity frames in relation to a reaction frame whereby the damper assembly can be made more efficient and cost effective.

Another object of the invention is to provide a displacement amplification apparatus for use with gravity frames slidably engaged over an "A"-shaped brace of the reaction frame.

Another object of the invention is to provide a displacement amplification apparatus for use with gravity frames having a reaction frame that is not located proximal a portion of the gravity frame which is subject to displacement.

Another object of the invention is to provide a displacement amplifying apparatus that is capable of redirecting the displacement energy being dissipated. Another object of the invention is to provide a displacement amplifying apparatus that is capable of directing the amplified displacement of the civil structure to dampers attached at any of a number of locations, including the gravity frame, the reaction frame, or the base level.

Another object of the invention is to provide a displacement amplifying apparatus that is capable of directing the amplified displacement of the civil structure to dampers which are integrated within structural building elements.

Another object of the invention is to provide a displacement amplifying apparatus combined with a damper assembly, such that displacement forces are amplified and damped within a seismic isolator that has a lowered component count.

Another object of the invention is to provide a displacement amplifying apparatus for use in a seismic isolator which is both reliable and easily manufactured.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only, and where like reference numbers denote like parts.

DETAILED DESCRIPTION OF THE INVENTION

Referring more specifically to the drawings, for illustrative purposes the present invention is embodied in the apparatus generally shown and described in FIG. 1 through FIG. 22. It will be appreciated that the apparatus may vary as to configuration and as to details of the parts, and that the method may vary as to the specific steps and sequence, without departing from the basic concepts as disclosed herein.

Figure 1:
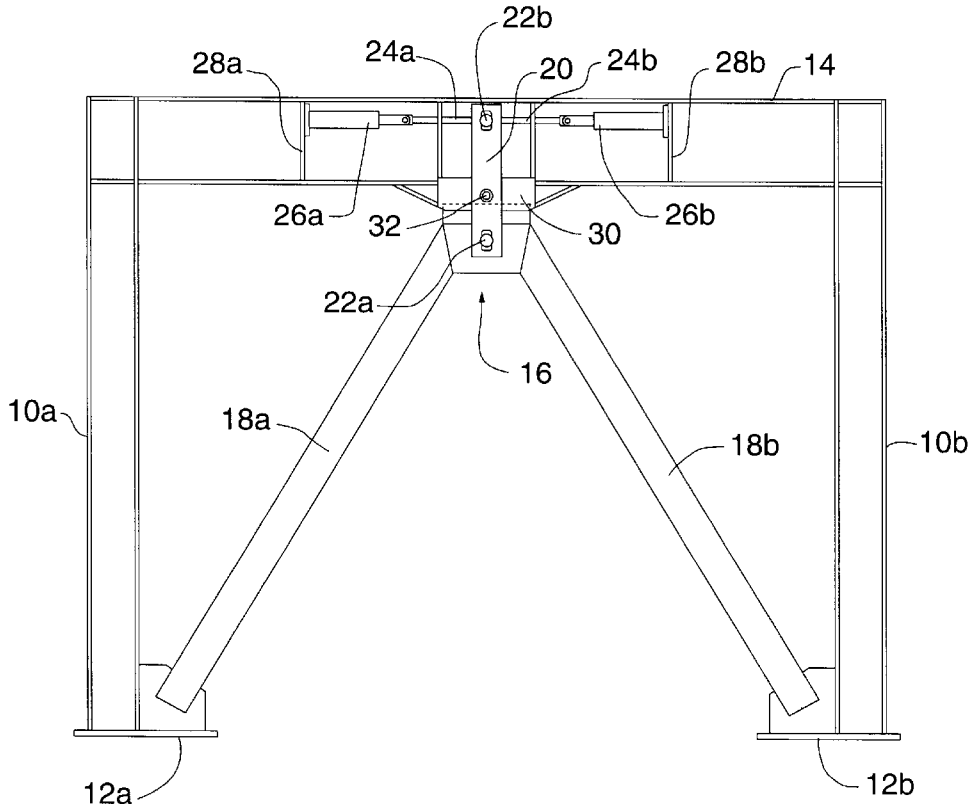
FIG. 1 is side schematic view of an embodiment of a lever-style displacement amplification apparatus according to the present invention installed in a gravity frame shown within a building.
Figure 2:
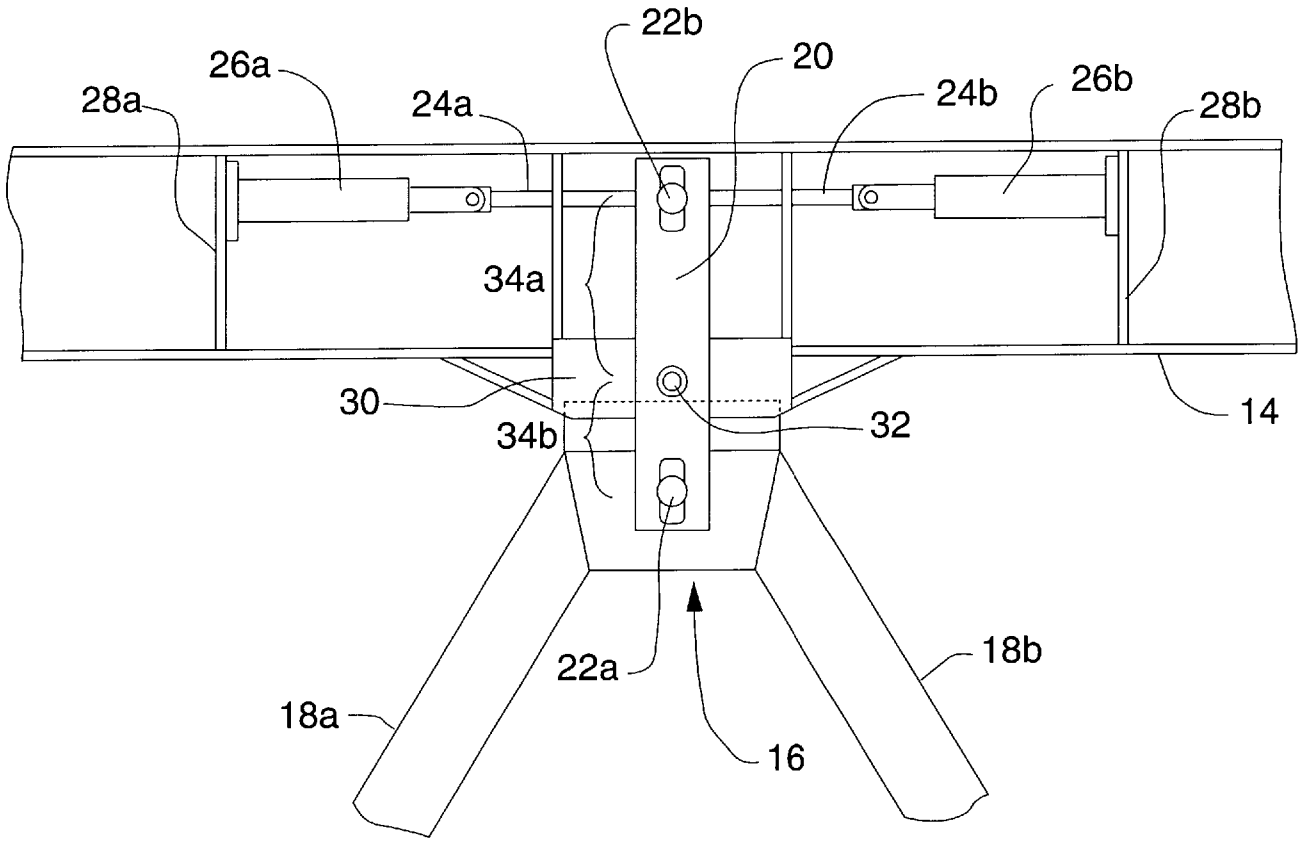
FIG. 2 is a detailed partial view of the displacement amplification apparatus of FIG. 1 shown in the context of the beam portion of the building frame.

FIG. 1 schematically shows a seismic isolation apparatus incorporating the displacement amplification apparatus of the present invention to dissipate the energy from the lateral displacement of a gravity frame in relation to a reaction frame implemented as an "A"-shaped brace slidably engaged with the horizontal girder at mid-span with roller-bearings. The triangular structure comprises a pair of legs having proximal ends rigidly attached to the base level and distal ends fixedly joined to one another at a roller bearing assembly which supports the girder and provides for mounting of the displacement amplifying apparatus. The building frame (gravity frame) is shown having a pair of vertical columns 10*a*, 10*b* extending from support bases 12*a*, 12*b* at their lower ends to a horizontal girder 14 at their upper ends. It will be appreciated that this gravity frame structure, which is shown in its static or undeformed position in FIG. 1, forms no part of the invention but constitutes the working environment. Referring to FIG. 1 and FIG. 2, the invention comprises a displacement amplification system that is configured for attachment to the gravity frame structure thus described. In the embodiment of the invention shown in FIG. 1 and FIG. 2, an "A"-shaped brace 16 having a pair of legs 18*a*, 18*b* is rigidly attached to bases 12*a*, 12*b* at the lower ends of legs 18*a*, 18*b*. The upper end of brace 16 is positioned beneath girder 14 and is coupled to girder 14 by means of a lever 20. One end of lever 20 is pivotally coupled to brace 16 with a coupling 22*a*, and the other end of lever 20 is pivotally coupled with a coupling 22*b* to piston rods 24*a*, 24*b* on fluid viscosity dampers 26*a*, 26*b* or the like. It should be appreciated that the pivoting lever may be implemented as members of various shapes including straight, curved, or other shapes having mounting points that are radially displaced from a pivot point and yet need not be collinear with the pivot. Note that the pivotal couplings 22*a*, 22*b* comprise a pin or the like that extends through a hole in lever 20 which is preferably elongated according to the amount of displacement expected. Use of an elongated hole in lever 20 is an important feature which allows for movement of brace 16 and/or girder 14 in relation to lever 20. A rigid connection is not desired since the stresses that can be placed on the coupling points during deformation could cause shearing. Fluid viscosity dampers 26*a*, 26*b* are in turn coupled to vertical cross-members 28*a*, 28*b* in girder 14. Lever 20 is also pivotally coupled to a bottom flange 30 of girder 14 with a roller bearing 32 or the like at a point along lever 20 that is offset from the longitudinal center of lever 20. The result is that two arms 34*a*, 34*b* are created in lever 20 between coupling 32 and couplings 22*a*, 24*b* at the ends of the lever, respectively, with arm 34*a* being necessarily shorter than arm 34*b* for displacement amplification according to the invention.

Figure 3:
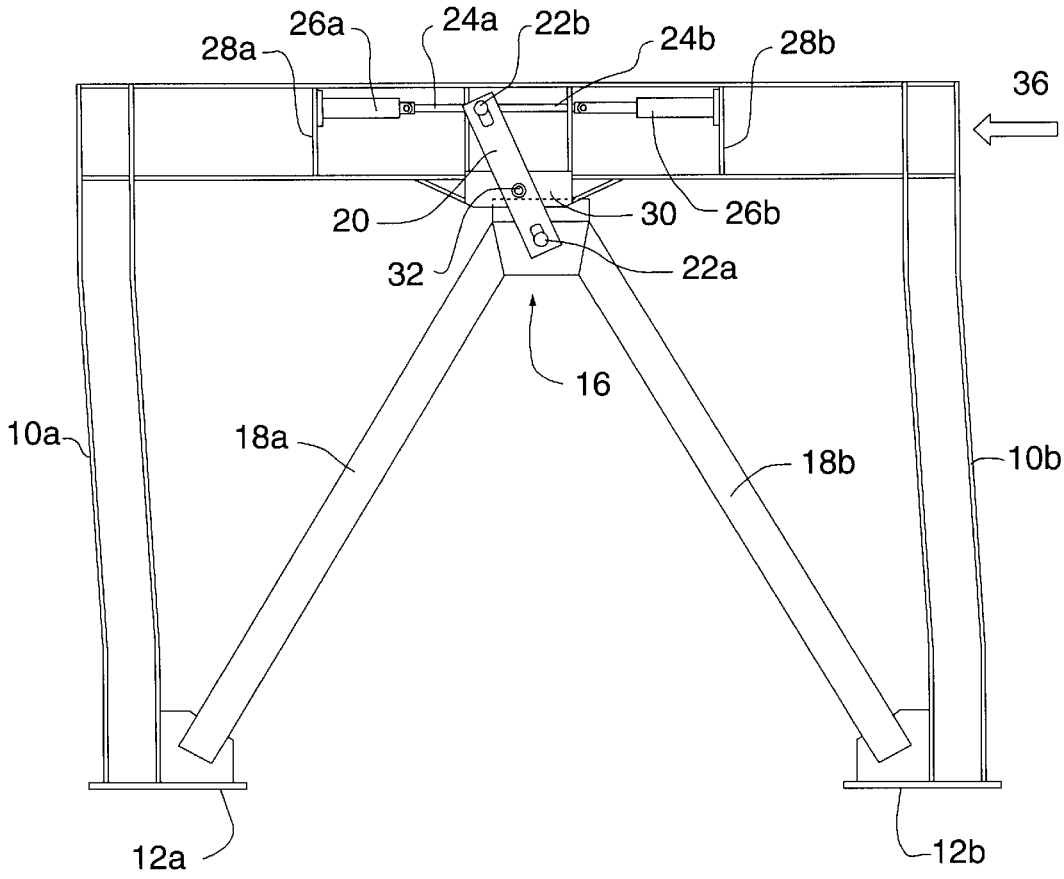
FIG. 3 is a side schematic view of the structure shown in FIG. 1, shown undergoing lateral deformation.
Figure 4:
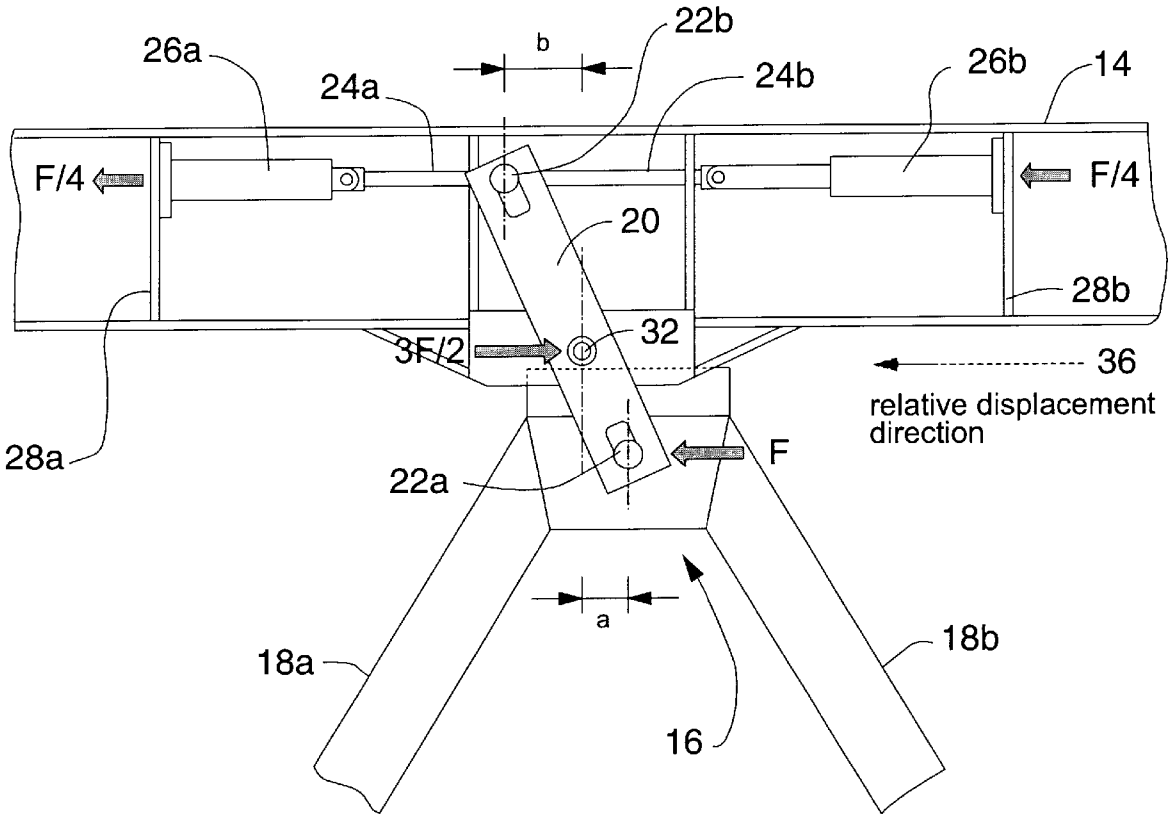
FIG. 4 is a detailed partial view of the displacement amplification apparatus of FIG. 1, shown in the context of the beam portion of the building frame in response to lateral displacement.
Figure 5:
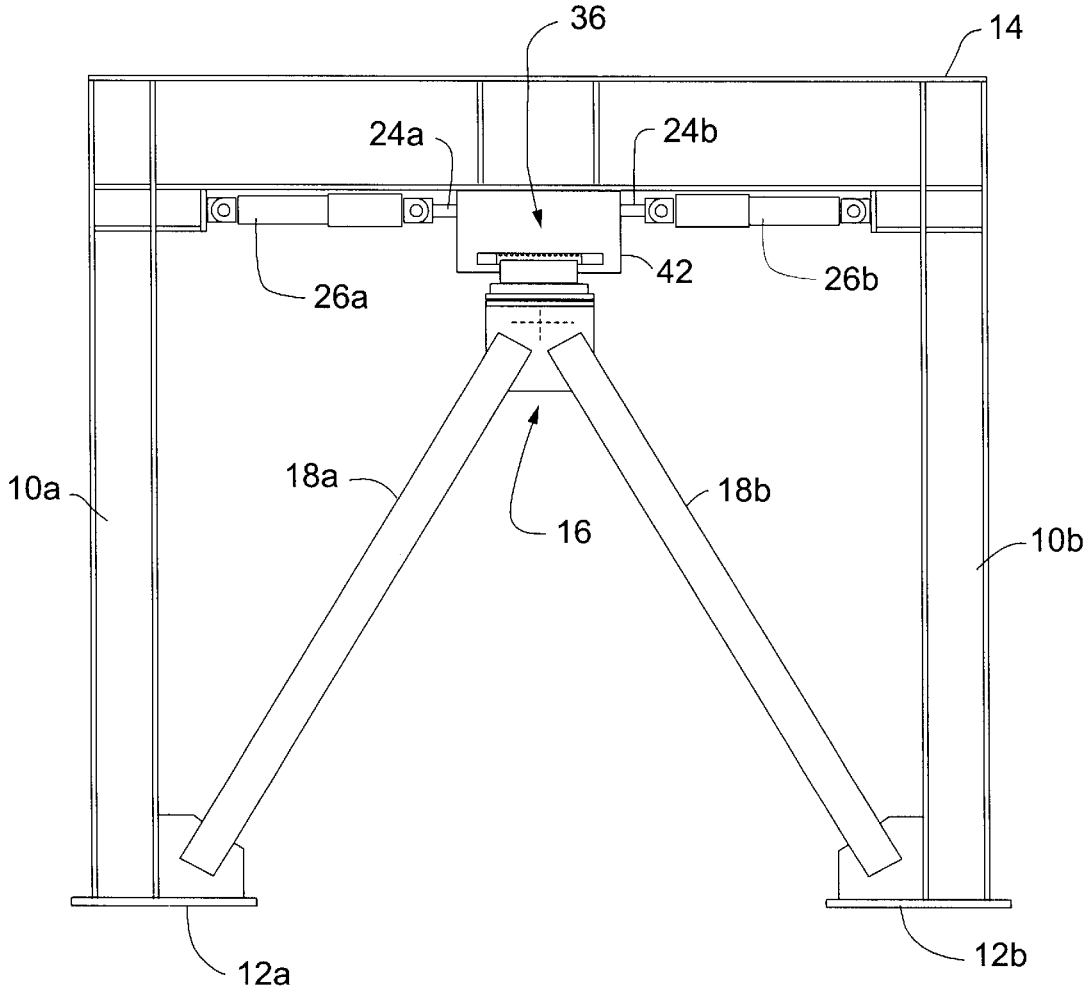
FIG. 5 is a side schematic view of an embodiment of a gear-style displacement amplification apparatus according to an embodiment of the present invention shown installed in a building frame.
Figure 6:
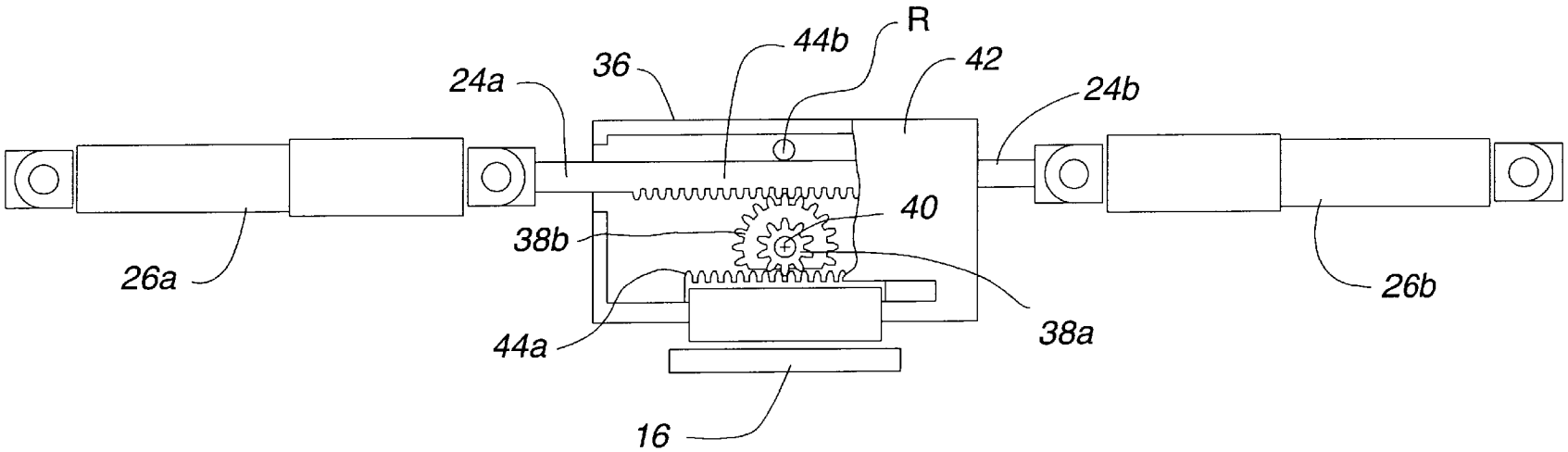
FIG. 6 is a detailed partial cutaway view of the displacement amplification apparatus of FIG. 5.

Referring now to FIG. 3 and FIG. 4, in the event of lateral deformation of the gravity frame, columns 10*a*, 10*b*, girder 14 will move laterally and lever 20 will rotate about coupling 32. In the example shown in FIG. 4, the amount of lateral displacement in the relative displacement direction 36 is denoted by "a". Lever 20 will amplify the inter story displacement in relation with the reaction frame so that the displacement applied to dampers 26*a*, 26*b* will be the inter story displacement multiplied by the ratio of the length of arm 34*b* to the length of arm 34*a*. In other words $$b=\beta a$$

$$\alpha=L2/L1$$

where b=displacement applied to the pistons of the dampers, a=inter story displacement, L1 length of shorter lever arm, and L2=length of longer lever arm. The effective damper stroke is increased while, at the same time, the required amount of applied force F at the damper mounting points 28*a*, 28*b* is reduced. In FIG. 4, for $\alpha=2$, the amount of force required at the damper mounting points is reduced to F/4.

Figure 7:
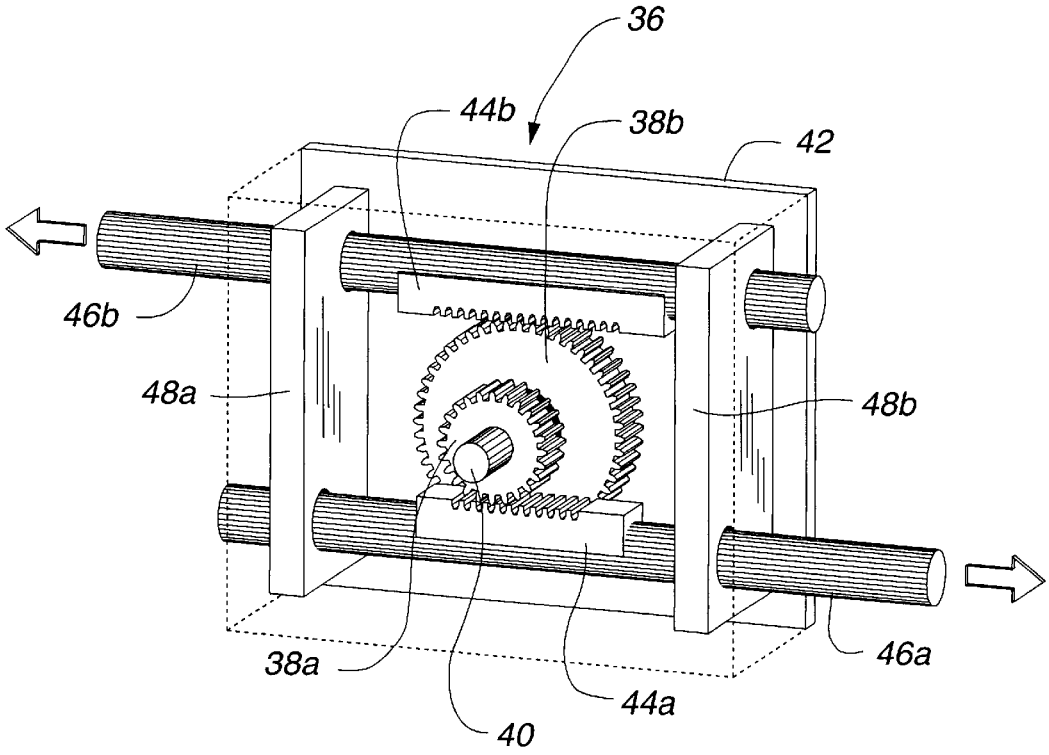
FIG. 7 is a perspective view of an alternative embodiment of the gear-style displacement amplification apparatus shown in FIG. 6.

While a displacement amplification system according to the invention can be implemented using a simple lever system as described above, it is not limited to use of a lever system. For example, referring to FIG. 5 and FIG. 6, the invention can be embodied in a displacement amplifying apparatus that utilizes a gearset having gears of different diameters that amplify motion received by a small gear to an output driven by a larger gear which is substantially concentric with said small gear. It will be appreciated that the mechanical displacement applied to the damper is amplified by the ratio of the diameter of the larger output gear in relation to the diameter of a smaller input gear. A displacement amplification device 36 is illustrated that employs two concentric connected gears 38*a*, 38*b* of differing radius which are fixedly connected at their centers with a pin 40 or the like. The gear assembly is in turn rotatably coupled to a housing 42 using such as pin 40 extending into a bearing in housing 42. A lower gear track 44*a* provides a linear coupling member which is joined to brace 16 and an upper gear track 44*b* provides a another linear coupling member which is coupled to pistons 24*a*, 24*b* of dampers 26*a*, 26*b*. The gear tracks can be guided by, and move in relation to, a roller R that also resists the radial force developed by the gear system. Dampers 26*a*, 26*b*, as well as housing 42 are mounted beneath girder 14 as shown. Here, inter story displacement is amplified by the ratio of the diameter of the larger gear 38*b* to the diameter of the smaller gear 38*a*. FIG. 7 shows an alternative embodiment of this geared displacement amplification device where connecting rods 46*a*, 46*b* are coupled to the gear tracks 44*a*, 44*b* and slide within supports 48*a*, 48*b* attached to housing 42.

Figure 8:
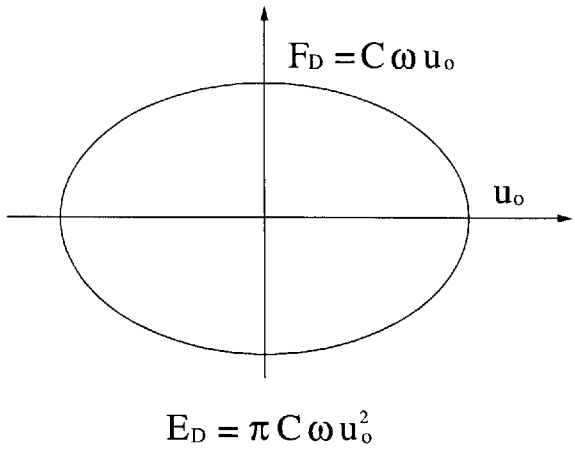
FIG. 8 is a diagram depicting the response of a fluid viscous damper undergoing cycling load without a displacement amplification apparatus according to the present invention.
Figure 9:
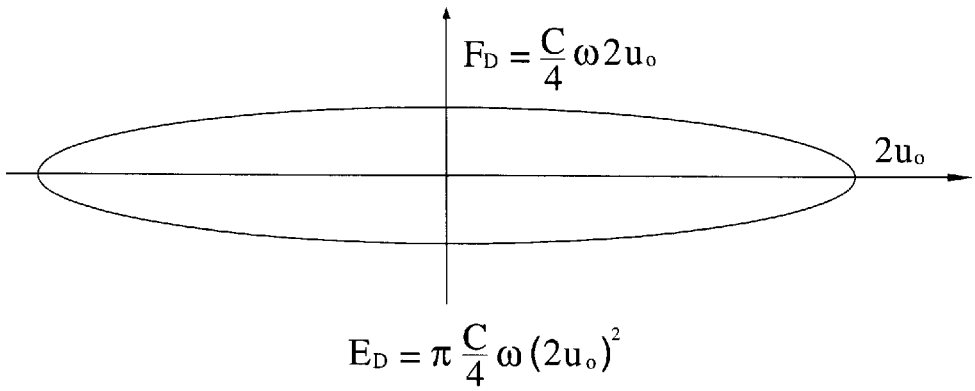
FIG. 9 is a diagram depicting the response of a fluid viscous damper undergoing cycling load with a displacement amplification apparatus according to the present invention.

The operational theory behind the displacement amplification system can be explained by applying a cycling load to two different cases using a linear fluid viscous damper and comparing the amounts of energy dissipated. Referring to FIG. 8, in the first case, a fluid viscous damper with a damping coefficient C=Co is used with no displacement amplification device. Referring to FIG. 9, in the second case, a fluid viscous damper with a damping coefficient C=Co/4 and a displacement amplification device with an amplification factor β=2 is used. The same load cycle is applied to both systems. The frequency of the load applied to the dampers in both systems will be the same, but the displacement and velocity applied to the damper in the second system is doubled. The energy displaced will also be the same for the two systems.

For the first case, $$E_D=\pi C_0\omega u_0^2.$$

and for the second case, $$E_D=\pi C_0/4\omega(2u_0)^2=\pi C_0\omega u_0^2.$$

This means that, if linear fluid viscosity dampers are used with a displacement amplification device with an amplification factor of two, only a damper with ¼ of the original damping coefficient needs to be utilized to produce the same effect.

Figure 10:
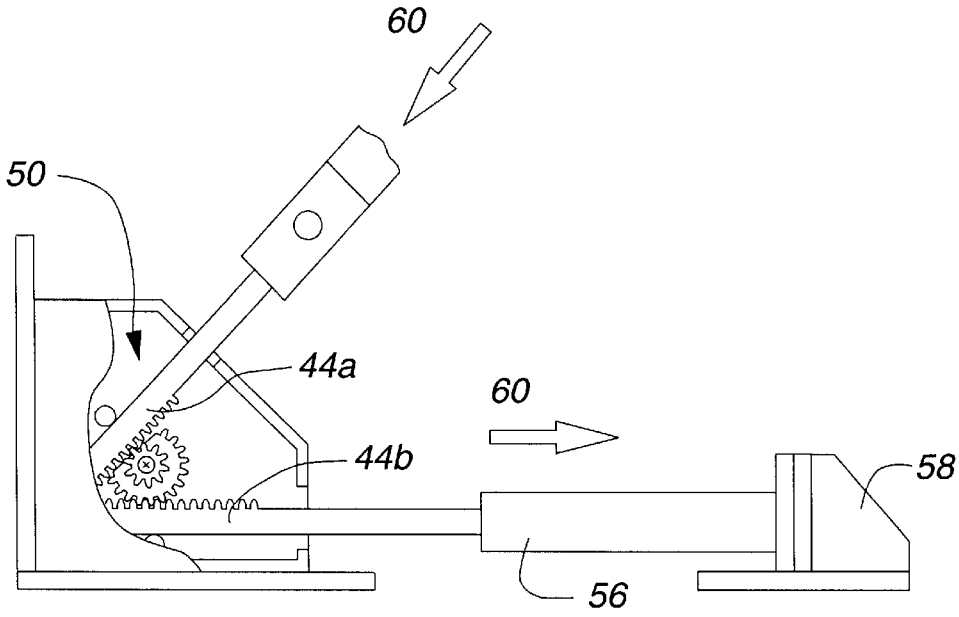
FIG. 10 is a partial cutaway view of an embodiment of a gear-style displacement amplification apparatus according to the present invention with angled gear tracks.
Figure 11:
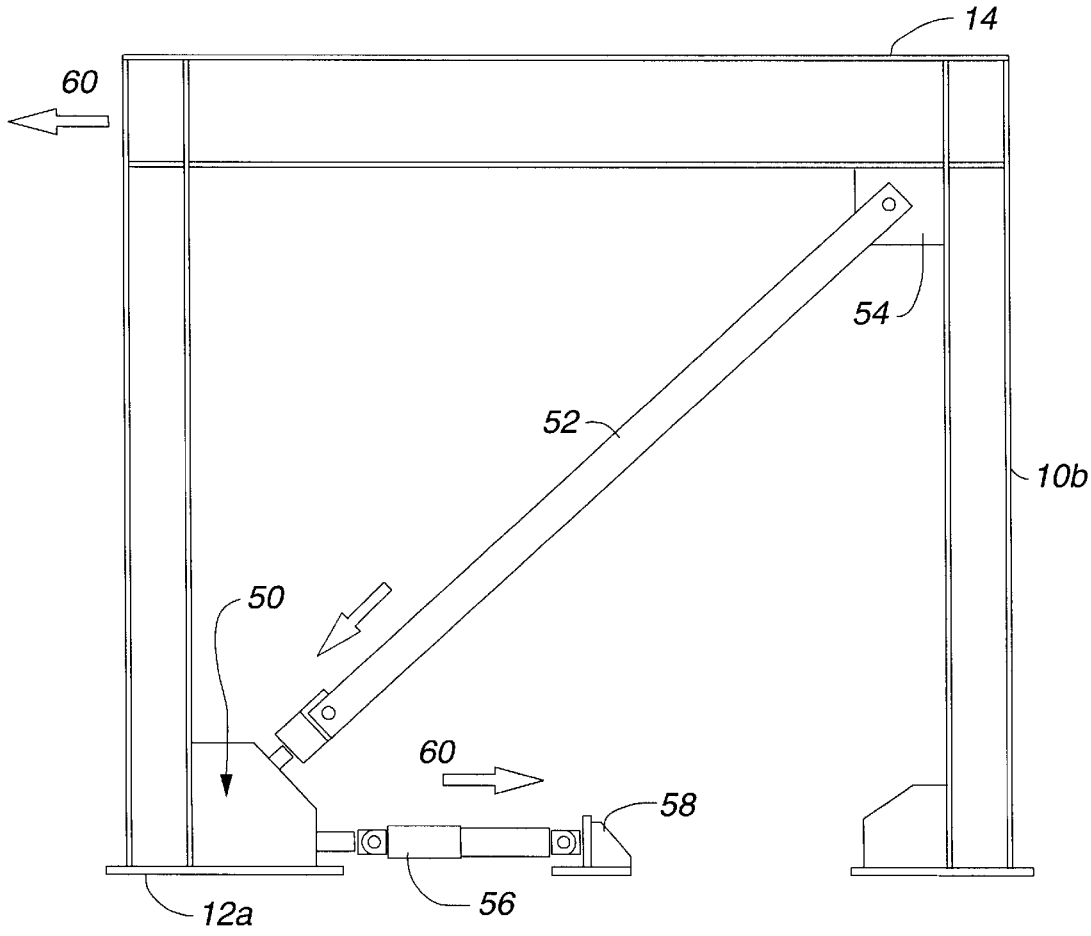
FIG. 11 is a side schematic view of the gear-style displacement amplification apparatus of FIG. 10 shown installed in a building structure with a cross-brace.

Referring now to FIG. 10 and FIG. 11, not only can the invention be used to amplify the displacement but it can be used to change the direction of the displacement. These drawings figures show an alternative embodiment 50 of a geared displacement amplification system where, instead of tracks 44*a*, 44*b* being substantially parallel to each other as in FIG. 5 through FIG. 7, the tracks are set at a relative angle. The displacement amplification device 50 is placed within reaction frame that is substantially displaced from the gravity frame at the foot of the frame in once corner. The motion of the gravity frame is conveyed between the gravity frame and the reaction frame by a diagonal support member, such as a cross-brace, which has a proximal end configured for attachment to the mechanical displacement amplifying means, and a distal end configured to attach to the structure. One end of a diagonal cross-brace 52 is connected to track 44*a* with the smaller gear 38*a*. The other end of cross-brace 52 is coupled to a bottom flange 54 on girder 14 at the upper corner of the frame. Track 44*b* with the larger gear is coupled to a damper 56 that in turn is connected to a stationary base 58. This configuration changes the inter story drift 60 from one direction to the opposite direction as shown in the drawing. This can be helpful in the case where there are design constraints or in the seismic retrofit of bridges. Also, fluid viscous dampers where the exponent of the damping coefficient is less than one can be used. Such dampers are efficient and, therefore, more energy can be dissipated.

Figure 12:
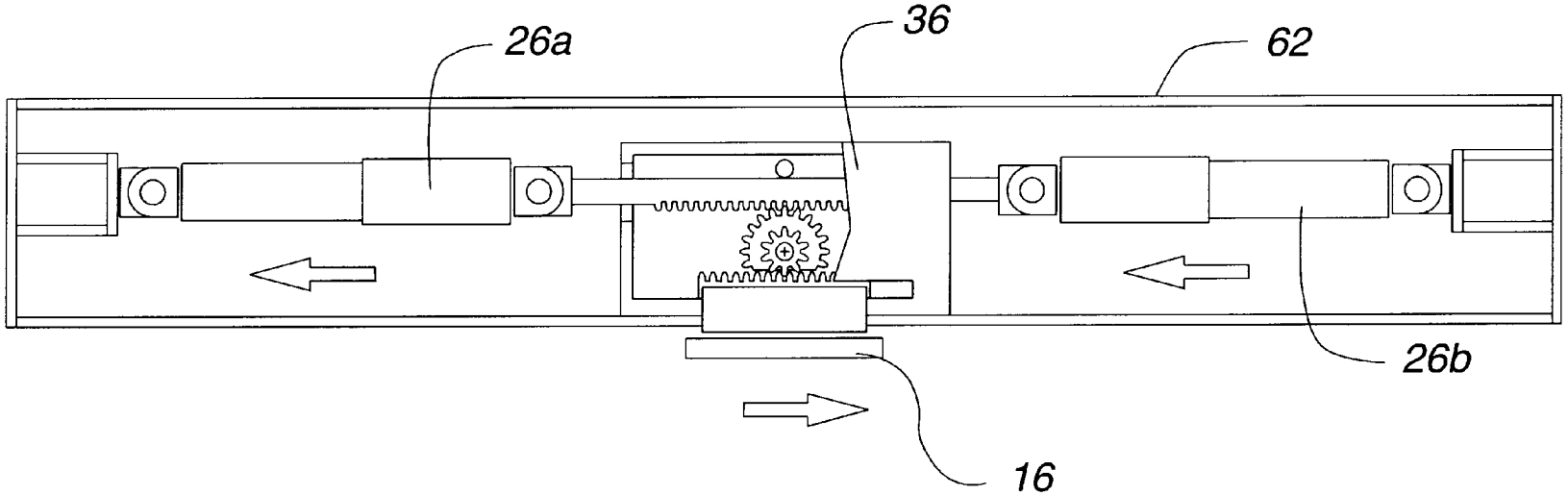
FIG. 12 is a side schematic view of a damper beam employing the gear-style displacement amplification apparatus shown in FIG. 6.
Figure 13:
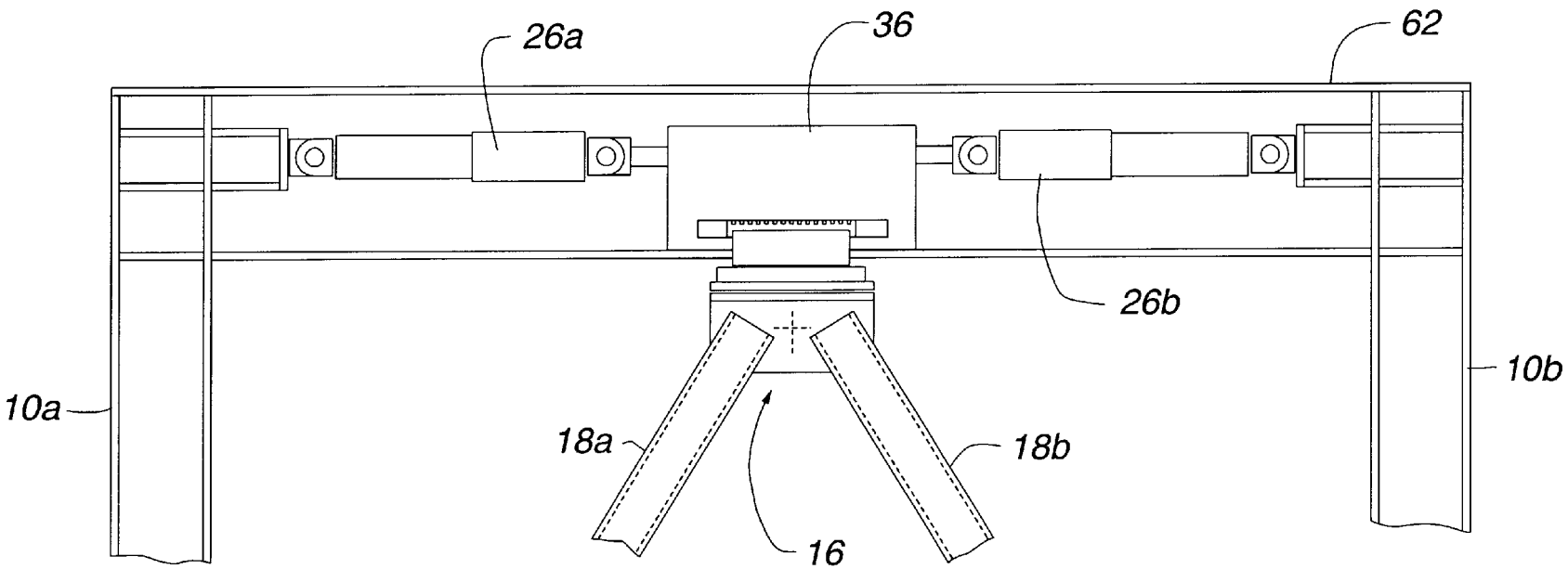
FIG. 13 is a side schematic view of the damper beam of FIG. 12 shown within a building frame.

Referring to FIG. 12, the invention can also be embodied as a damper beam 62 that is constructed and tested prior to installation into the structure. Damper beam 62 would be an integral unit comprising girder 14, displacement amplification device 36, and dampers 26*a*, 26*b*. An example of how damper beam 62 would be installed is shown in FIG. 13.

Figure 14:
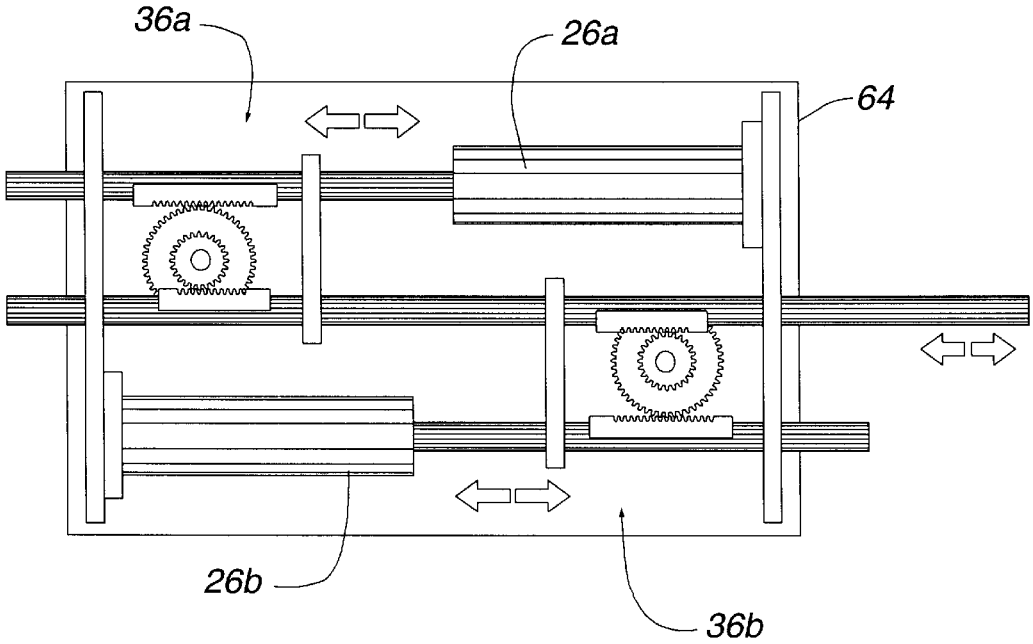
FIG. 14 is a top plan schematic view of a super-damper according to an embodiment of the present invention.

A displacement amplification device according to the invention can be embodied in various other ways as well. For example, FIG. 14 shows a form of rotating "super damper" that is very sensitive to the applied displacement. This rotating damper apparatus integrates the mechanical displacement amplifying means with a damper. The motion input to the rotating damper is converted to a rapid rotation of a propeller retained within a housing filled with viscous fluid. Multiple independent gear-driven propellers may be utilized, which may are preferably configured for coupling to a linear coupling member having multiple pinions. Configuring the multiple gear-driven propellers for counter-rotation in close proximity to one another within said fluid filled housing greatly increases the rotational damping effect. In this embodiment the rotating damper 66 comprises a pair of displacement amplification devices 36*a*, 36*b* having connecting rods as shown in FIG. 7 have been integrated into a single unit 64 with a pair of dampers 26*a*, 26*b*. By employing a configuration as shown, the dissipation capacity of small dampers can be greatly improved. Also, a plurality of "super-damper" devices rather than a few dampers with high capacity can achieve a cost-effective improvement of the seismic response of a structure.

Furthermore, it should be appreciated that FIG. 14 represents a single method of integrating a pair of displacement amplification devices and dampers; other configurations are contemplated as well. In addition, the size and type of the gear mechanisms and size of the pin connections can vary depending on the size and type of dampers. Furthermore, the geared amplification mechanism could be replaced with a lever-type mechanism of the type described in FIG. 1 and FIG. 2. In any such configuration, however, a possible practical limitation can be the fact that, in order to transfer the relative large forces developed by the dampers, the gears must be sufficiently strong that only small dampers can be used. However, since the maximum forces developed by the particular dampers used are known, the gear mechanisms can be designed to be reliable and effective.

Figure 15:
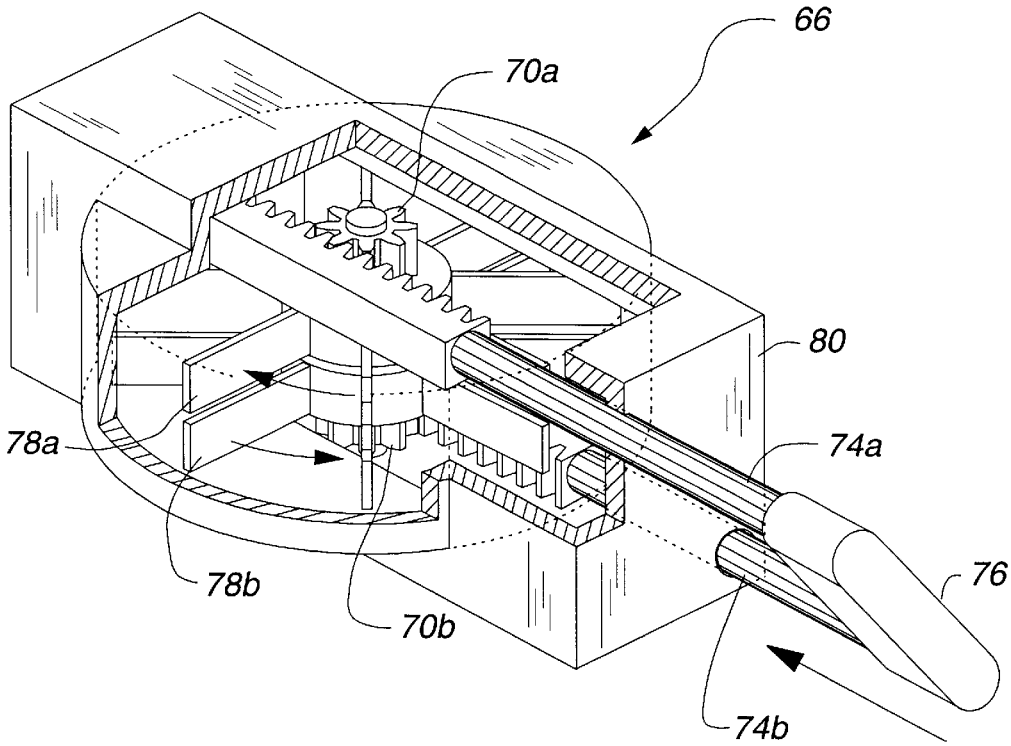
FIG. 15 is a perspective view of a turbo-damper according to an embodiment of the present invention.
Figure 16:
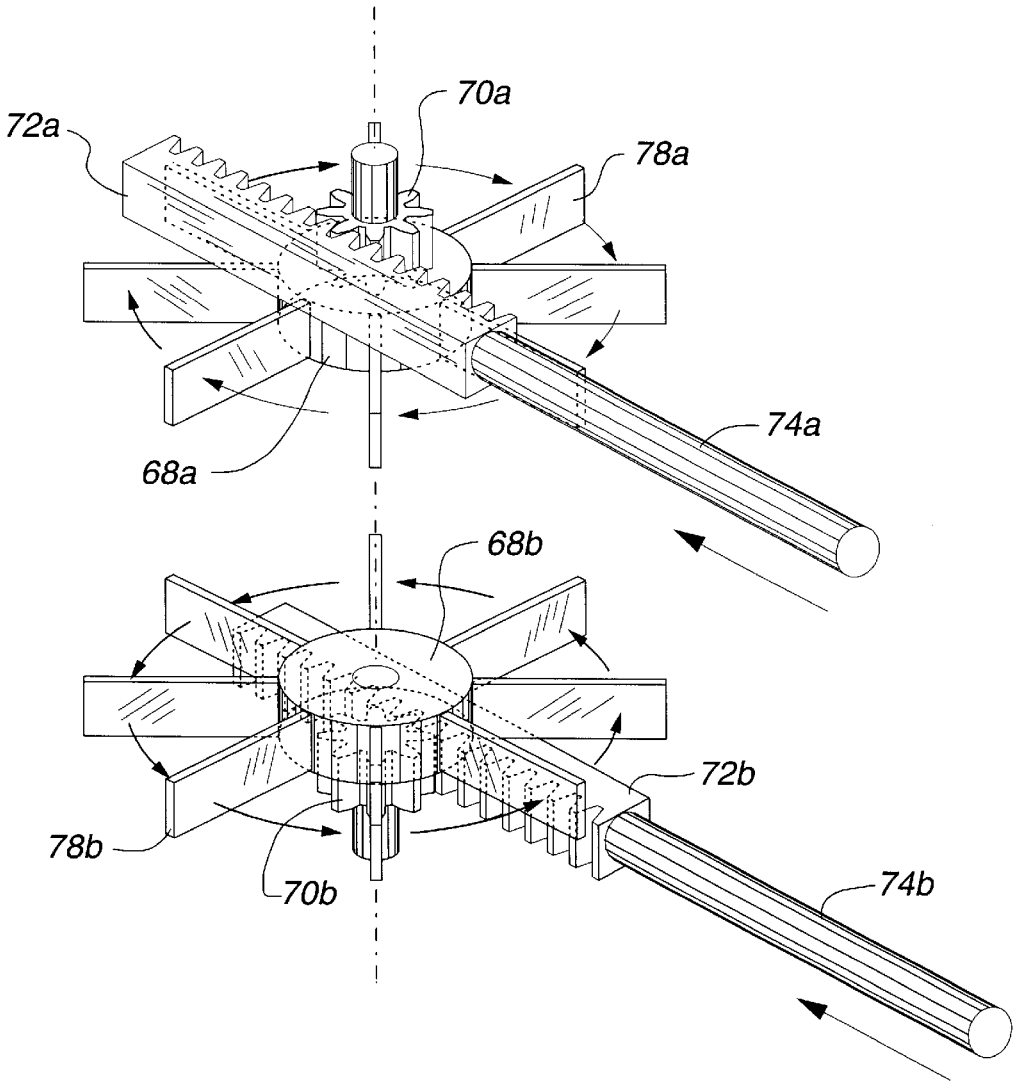
FIG. 16 is an exploded view of gear and propeller mechanism employed in the turbo-damper shown in FIG. 15.

Referring now to FIG. 15 and FIG. 16, a "turbo damper" 66 is shown which employs a rack-pinion system. In this embodiment, instead of amplifying the displacement and transferring the amplified displacement to a damper, the displacement is amplified and converted into rotational energy by turbo damper 66. Turbo damper 66 includes a pair of propellers 68*a*, 68*b* having corresponding gears or pinions 70*a*, 70*b*. By connecting the pinions to the propellers, rotation of the pinions is transferred to the larger diameter propellers thereby resulting in displacement amplification. The propellers are rotationally coupled at their centers so that they can rotate in opposite directions. A pair of tracks 72*a*, 72*b* and corresponding connecting rods 74*a*, 74 are associated with propellers 68*a*, 68*b*, respectively. The exposed ends of the connecting rods are joined by coupling 76 for connection to the structure. As can be seen, the propellers are assembled in such a way that the propeller blades 78*a*, 78*b*, which are preferably flat plates or paddles, will rotate in opposite directs when a force is applied to coupling 76. These components are carried by a housing 80 that is filled with a viscous fluid that engulfs propeller blade 78*a*, 78*b* and acts as a damper. When a displacement force is applied to coupling 76, the propellers rotate and the blades start moving back and forth in the fluid, thereby producing viscous forces and heat. Because the blades rotate in opposite directions, the fluid inside the device is device is forced to move against the blades of the opposite set, thereby producing turbulence and increasing the ability to dissipate energy. Since the device can be made in such a way that the external radius of the propeller is much larger than the radius of the pinions, the velocity to which the blades move inside the fluid can be several times the velocity applied to the devices. The characteristics of this damper, such as the normal force and the damping coefficient, can be controlled by several parameters, such as the diametral pitch of the pinions, the viscosity of the fluid, and the geometry, dimensions and relative orientation of the rotating blades.

Figure 17:
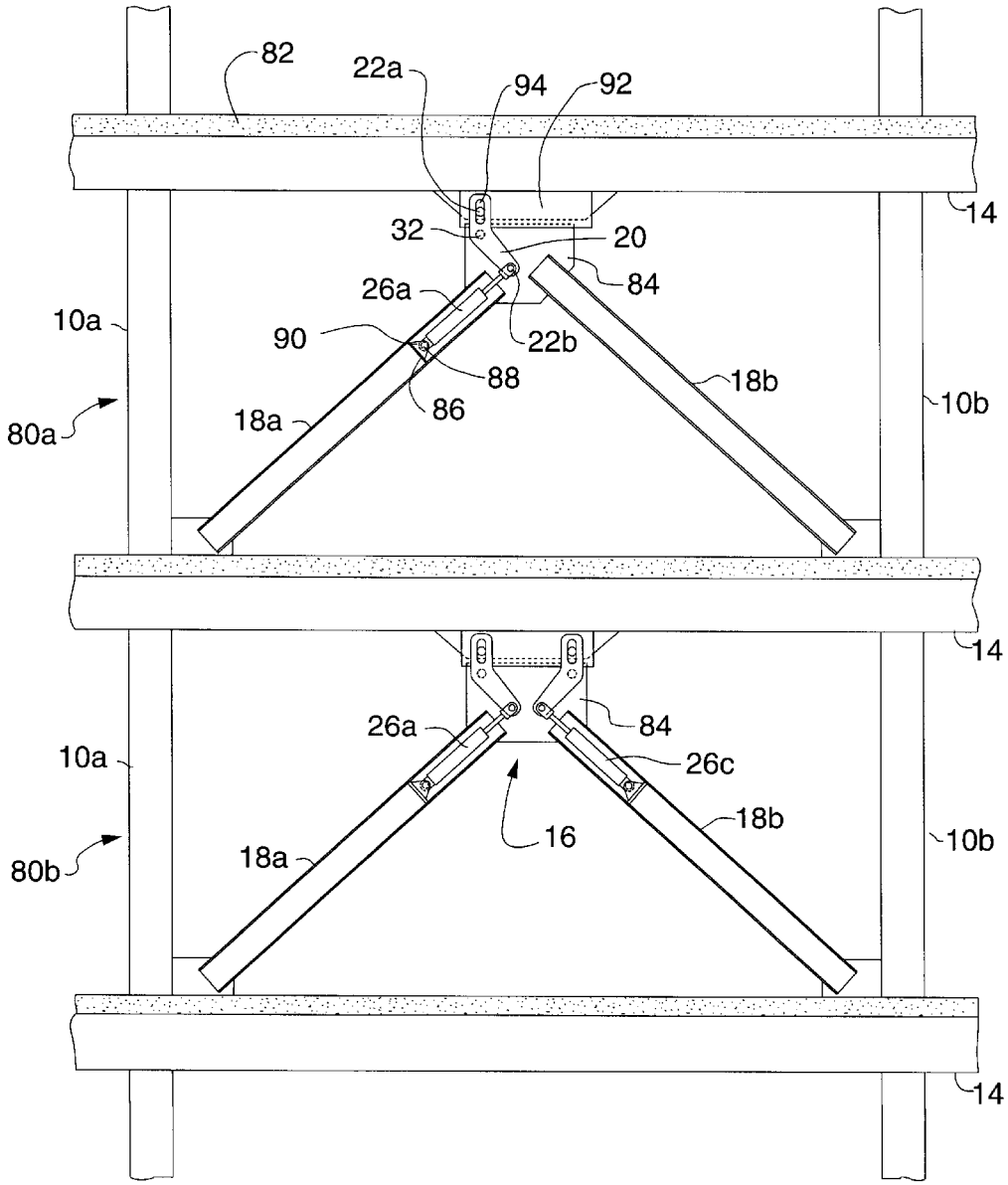
FIG. 17 is a side schematic view of a multi-level building structure employing an alternative embodiment of the lever-style displacement amplification apparatus according to an embodiment of the present invention.
Figure 18:
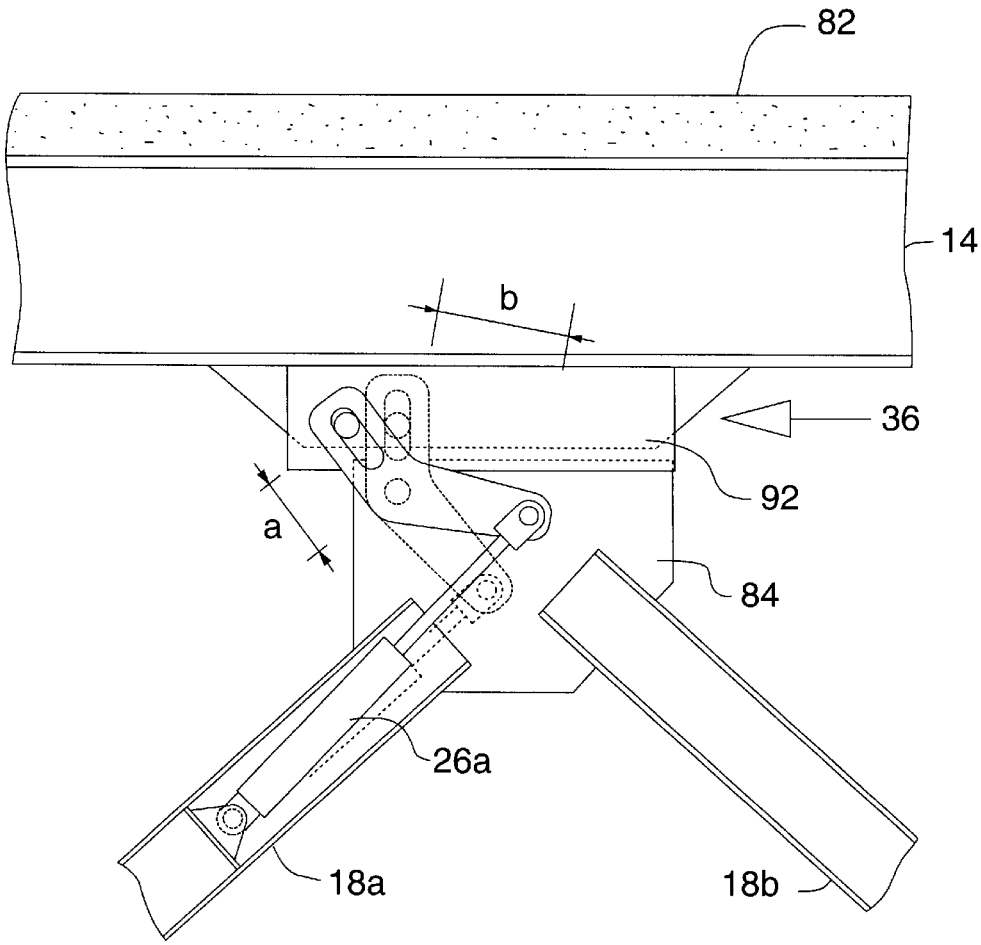
FIG. 18 is a partial detail view of the displacement amplification apparatus employed in FIG. 17 shown in the context of a beam undergoing lateral displacement.
Figure 19:
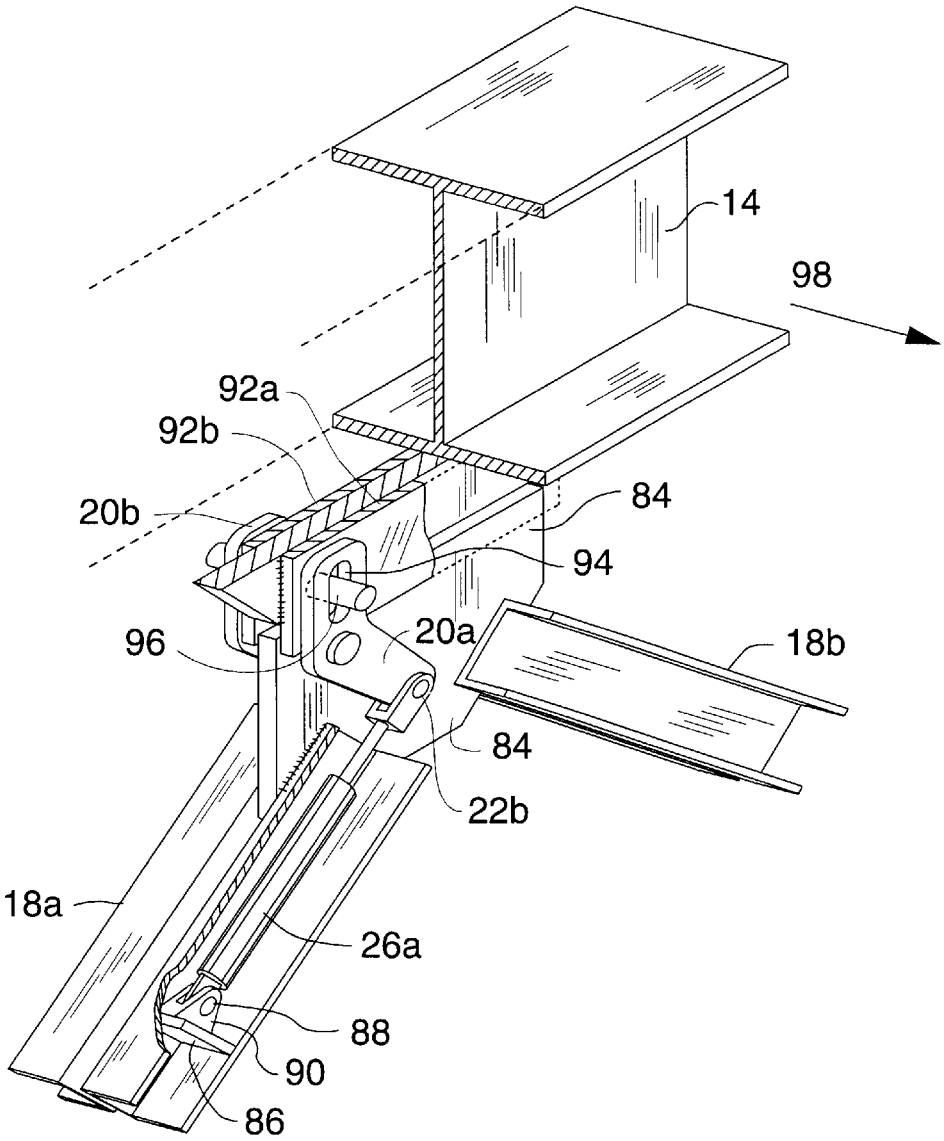
FIG. 19 is a detailed partial perspective view of the displacement amplification apparatus employed in FIG. 17.

FIG. 17 through FIG. 19 depict implementations of the lever type displacement amplification system according to the invention that are particularly suited for seismic and wind applications of stiff buildings. These configurations are based on the same principles described in connection with the configurations shown in FIG. 1 through FIG. 4 and further illustrate the advantages of the present invention compared to conventional approaches. In these embodiments, the dampers are relocated from beam 14 to legs 18*a*, 18*b* of brace 16. As a result, instead of lever 20 being a linear lever as shown in FIG. 1 through FIG. 4, lever 20 is angled to accommodate the placement of the dampers. Shear key plates are also used to allow for slight out of plane motion.

For example, FIG. 17 depicts a multi-story building structure where two levels 80*a*, 80*b* are shown, each level being differentiated by beam 14 that supports a concrete slab 82. The upper portions of legs 18*a*, 18*b* of brace 16 are rigidly connected to a steel plate 84 which is not attached to beam 14 but which abuts or is placed slightly below beam 14 by an acceptable amount of vertical displacement. Legs 18*a*, 18*b* would typically be conventional double "C" or "U" braces. In upper level 80*a*, damper 26*a* would be installed in the front side of leg 18*a*, and be coupled at its base to cross-member 84 using a pin 88 and clevis 90. The piston would then be coupled to the long arm of lever 20 using pivotal coupling 22*b*. Note that there is no need to elongate the corresponding hole in lever 20 in this configuration. Lever 20 is pivotally coupled to plate 84 at its bend or fulcrum point using coupling 32. The other end of lever 20, which includes an elongated hole 94, is coupled to a shear key plate 92 using pin 96. Shear key plate is in turn rigidly attached to beam 14. The entire configuration described above is duplicated on the back side of leg 18*a* as depicted in FIG. 19.

FIG. 17 also shows how additional dampers could be incorporated into the system if desired. As can be seen with respect to lower level 80*b*, both legs of brace 16 are fitted with dampers. For example, leg 18*b* would include a pair of dampers 26*c* and 26*d* (not shown) and associated lever mechanisms.

FIG. 18 schematically depicts movement in the direction 36 showing how the beam and shear key plates will move in relation to plate 84 and brace 16, and the relative movement of the levers and dampers.

Referring more particularly to FIG. 19, this configuration has many practical advantages. First, coupling the lever to the shear key plate beam using a pin extending through an elongated hole allows for relative vertical movement. Second, movement in the out of plane direction 98 is limited to a small space between the two shear key plates 92*a*, 92*b* and plate 84 which is sandwiched between the two shear key plates. For example, using such shear key plates will allow the frame to move in the out of plane direction with respect to brace system only very little (e.g., 0.5 in). Third, lever connection using a pin extending through an elongated hole also allows for relative movement in the out-of-plane direction (at least for the small amount allow by the shear key plates). These features allow the system to be used to reduce seismic deformations and wind induced vibrations of tall and rigid buildings.

Figure 20:
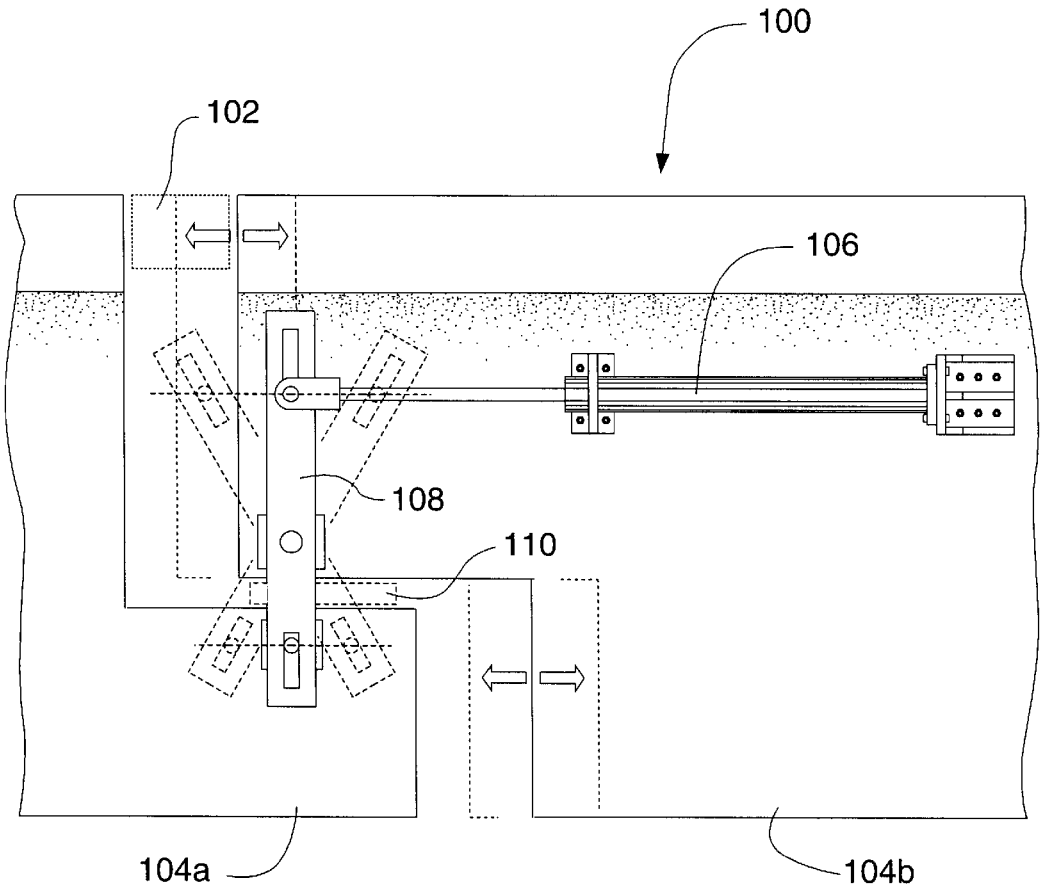
FIG. 20 is a side schematic view of a lever-style displacement amplification apparatus according to an embodiment of the present invention, shown configured for use within a bridge having an expansion joint.

FIG. 20 depicts the lever system of the present invention applied to a bridge application where a joint of a bridge with the damper and lever system is schematically shown. The joint of the bridge is basically a cut in the structure to allow movement such induced by shrinkage, creep deformations and temperature changes. To fill the gap and allow the traffic to over the surface 100 of the bridge, an expansion joint 102 is used between the cut sections 104*a*, 104*b*. However, these joints are quite sophisticated and expensive. On the other hand, by using the present invention, a damper 106 coupled to a lever 108 and a bearing 110 made from neoprene or the like can be used to reduce the relative displacements that can occur during an earthquake in order to reduce the size of the expansion joints and reduce possible damage.

Figure 21:
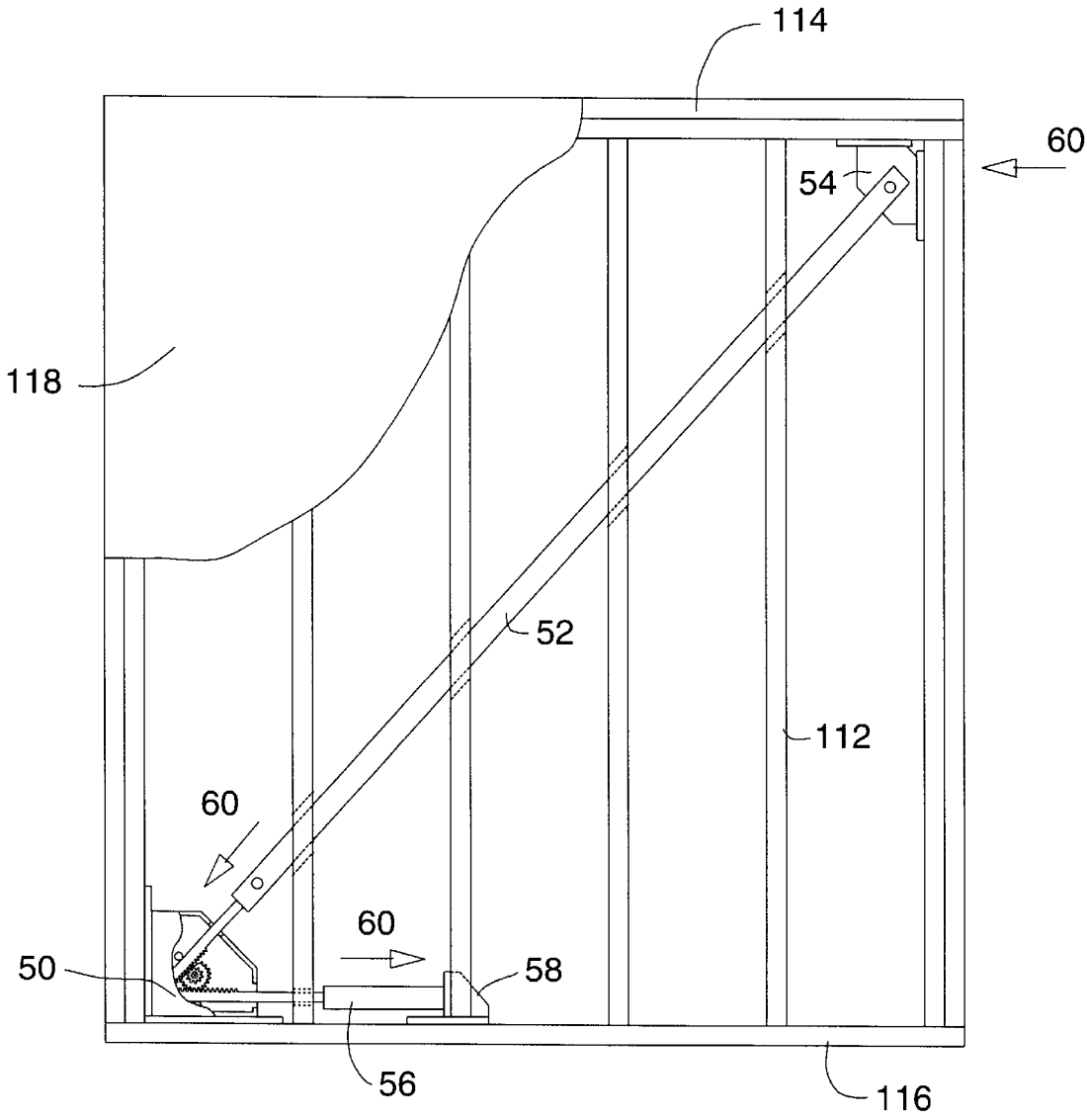
FIG. 21 is a side schematic view of the displacement amplification apparatus of FIG. 10 shown installed in a wood frame shear wall.

FIG. 21 depicts an implementation of the gear type displacement amplification system according to the present invention which is similar to that shown in FIG. 10 and FIG. 11. Here, however, the invention is shown in the context of a wood frame building for which the gear type mechanism 50 is particular well suited. One of the potential limitations of the gear type system is the size of the forces that can be transferred without breaking the gears. However, in the case of wood frame buildings, the forces involved during an earthquake are much smaller since the material is much lighter. The example shown in FIG. 21 is of a shear wall section having a plurality of studs 112, a double top plate 114, a bottom plate 116, and plywood sheeting 118. In this configuration, cross-brace 52 would typically be a steel brace, square tube, 2×2 wood brace or the like. Otherwise, the configuration would be the same as shown in FIG. 10 and FIG. 11.

Figure 22:
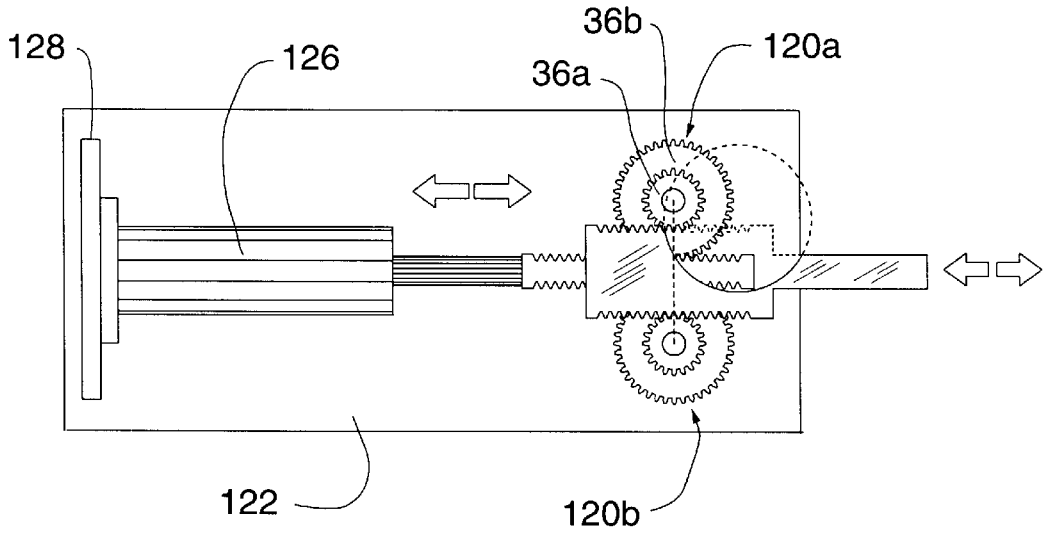
FIG. 22 is a top plan view of an alternative embodiment of a super-damper according to the present invention.

Referring now to FIG. 22 an alternative embodiment of the "super damper" of FIG. 14 is illustrated. In this embodiment, a pair of gear assemblies 120*a*, 120*b*, each of which would comprise a smaller diameter gear 36*a*, and larger diameter gear 36*b*, would be rotatably coupled to a steel plate 122 used as a base. A moveable track assembly 124 would be in turn coupled to the piston of a damper 126 and the other end of the damper would be connected to a steel plate 128 that is attached to base 122.

As can be seen, therefore, the invention can be implemented in various structures subject to lateral loads, such as earthquake ground motion, or wind load, and can be used in new structures as well as for seismic retrofitting of existing buildings or bridges. The invention is capable of drastically reducing the size of the dampers required to dissipate the energy. In additional, several small dampers can be used instead of large size dampers, providing better results and cost effectiveness. The overall response of structures to seismic events can be improved, thus reducing damage and possible loss of life. Additionally, a considerable amount of money can be saved in the construction of new seismic resistant structures or in retrofitting existing buildings or bridges. The amplifying of displacement can also be very useful for wood frame or masonry buildings wherein even the small relative displacement expected in to the elastic range can be used to dissipate a considerable amount of energy. In these applications, the major limitation on the implementation of passive energy systems has been the fact that the small relative displacements were generally insufficient to activate the passive energy systems. This problem is solved with a displacement amplification system according to the present invention.

Although the description above contains many specificities, these should not be construed as limiting the scope of the invention but as merely providing illustrations of some of the presently preferred embodiments of this invention. Thus the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An apparatus for placement within the gravity frame of a structure which amplifies inter story structural displacements to increase passive energy dissipation, comprising:

(a) a reaction frame rigidly coupled to a base level;

(b) means for amplifying mechanical displacement coupled between said reaction frame and said gravity frame, said means for amplifying mechanical displacement having a mechanical output; and (c) a damping device coupled to the mechanical output of said means for amplifying displacement;

(d) said means for amplifying mechanical displacement comprising (i) a generally concentric rotating gearset having a first gear connected to a larger second gear;

(ii) said first gear being coupled to a first linear coupling member subject to the relative linear displacement of the gravity frame in relation to the reaction frame;

(iii) said second gear coupled to a second linear coupling member which is attached to said damper device.

2. An apparatus as recited in claim 1, wherein the mechanical displacement applied to the damping device is amplified by the ratio of the diameter of a larger gear coupled to the damping device in relation to the diameter of a smaller gear coupled to a linear coupling member subject to the relative displacement of the gravity frame relation to the position of the reaction frame, wherein said smaller gear is connected for substantially concentric rotation with said larger gear.

3. An apparatus as recited in claim 1, wherein the coupling between the gears and the linear coupling members comprises a rack-pinion coupling mechanism.

4. An apparatus as recited in claim 1, wherein said mechanical displacement amplifying means is combined with said damping device within a rotating damper, said rotating damper comprising:

(a) a linear coupling member subject to the displacement of the gravity frame in relation to the reaction frame;

(b) a gear-driven propeller coupled to said linear coupling member and configured to amplify the motion of the linear coupling member into the rotational motion of said propeller; and (c) a housing filled with fluid surrounding said propeller.

5. An apparatus as recited in claim 4, wherein said coupling between said linear coupling member and said gear drive propeller is provided by a rack-pinion coupling mechanism.

6. An apparatus as recited in claim 4, wherein said linear coupling member is configured with multiple pinions for driving multiple gear-driven propellers.

7. An apparatus as recited in claim 6, wherein said multiple gear-driven propellers are configured for counter-rotation in close proximity to one another within said fluid filled housing.

8. An apparatus as recited in claim 1, wherein said damping device comprises an energy dissipation device configured for damping mechanical movement.

9. An apparatus as recited in claim 1, wherein said damping device comprises a fluid viscous damper.

10. An apparatus as recited in claim 1, wherein said damping device comprises a friction damper.

11. An apparatus as recited in claim 1, wherein said damping device comprises a viscous elastic damper.

12. An apparatus as recited in claim 1, wherein said reaction frame comprises a triangular structure configured for positioning beneath a horizontal support of said gravity frame.

13. An apparatus as recited in claim 12, wherein said reaction frame further comprises a slidable coupling attached to said triangular structure which supports said horizontal support within said gravity frame and restricts motion therein to substantially lateral movement.

14. An apparatus as recited in claim 13, wherein said slidable coupling incorporates rollers configured to allow lateral displacement of said horizontal support.

15. An apparatus as recited in claim 12 wherein said triangular structure comprises a pair of legs rigidly having proximal ends attached to the base level and distal ends fixedly joined to one another to provide a support for said mechanical displacement amplifier.

16. An apparatus as recited in claim 12, wherein said damping device is mounted within said triangular structure.

17. An apparatus as recited in claim 1, wherein said damping device is mounted within the gravity frame.

18. An apparatus as recited in claim 1, wherein said reaction frame comprises:

(a) a housing rigidly attached to the base level;

(b) said housing configured to receive said means for amplifying mechanical displacement;

(c) a diagonal support member having a distal end configured for attachment to said gravity frame at a selected location;

(d) said diagonal support member having a proximal end configured for attachment to said means for amplifying mechanical displacement such that displacement of said gravity frame at said location will induce movement of said diagonal support.

19. An apparatus for placement within a gravity frame of a structure which passively dissipates energy from structural displacements of said gravity frame, comprising:

(a) a reaction frame rigidly coupled to a base level;

(b) a mechanical displacement amplifier having an input coupled between said reaction frame and said gravity frame; and (c) a damper assembly coupled to the mechanical output of said displacement amplifier;

(d) wherein the mechanical displacement amplifier comprises (i) a gearset which is substantially concentric and contains gears of different diameters;

(ii) a first gear within said gearset coupled to a linear coupling member subject to the relative displacement of the gravity frame relation to the position of the reaction frame; and (iii) a second gear, of larger diameter than said first gear to amplify linear motion received therein, coupled to a linear coupling member which urges movement within said damper assembly.

20. An apparatus for placement within a gravity frame of a structure which passively dissipates energy from structural displacements of said gravity frame, comprising:

(a) a reaction frame rigidly coupled to a base level;

(b) a mechanical displacement amplifier having an input coupled between said reaction frame and said gravity frame; and (c) a damper assembly coupled to the mechanical output of said displacement amplifier;

(d) wherein said mechanical displacement amplifier comprises a generally concentric rotating gearset having a first gear attached to a larger second gear;

(e) wherein said first gear is coupled to a first linear coupling member subject to the relative linear displacement of the gravity frame in relation to the reaction frame; and (f) wherein said second gear is coupled to a second linear coupling member which is attached to said damper assembly.

21. An apparatus as recited in claim 19 or 20, wherein the coupling between the first gear and the linear coupling member is provided by rack and pinion coupling.

22. An apparatus as recited in claim 19 or 20, wherein said mechanical displacement amplifier is combined with said damper assembly within a rotating damper, comprising:

(a) a linear coupling member subject to the relative displacement of the gravity frame in relation to the reaction frame;

(b) a gear-driven propeller coupled to said linear coupling member and configured to amplify the linear displacement of the linear coupling member into the rotational motion of said propeller; and (c) a housing filled with viscous fluid surrounding said propeller.

23. An apparatus as recited in claim 22, wherein said coupling between said linear coupling member and said gear drive propeller is provided by a rack-pinion coupling.

24. An apparatus as recited in claim 22, wherein said linear coupling member is configured with multiple pinions for driving multiple gear-driven propellers.

25. An apparatus as recited in claim 24, wherein said multiple gear-driven propellers are configured for counter-rotation in close proximity to one another within said fluid filled housing.

26. An apparatus as recited in claim 19 or 20, wherein said damper assembly provides energy dissipation to damp the mechanical distortions of the gravity frame in relation to the reaction frame.

27. An apparatus as recited in claim 19 or 20, wherein said damper assembly comprises a fluid viscous damper.

28. An apparatus as recited in claim 19 or 20, wherein said damper assembly comprises a friction damper.

29. An apparatus as recited in claim 19 or 20, wherein said damper assembly comprises a viscous elastic damper.

30. An apparatus as recited in claim 19 or 20, wherein said reaction frame comprises a triangular structure configured for positioning beneath a horizontal support of said gravity frame.

31. An apparatus as recited in claim 30, wherein said reaction frame further comprises a slidable coupling attached to said triangular structure which supports said horizontal support within said gravity frame end restricts motion therein to substantially lateral movements.

32. An apparatus as recited in claim 31, wherein said slidable coupling incorporates rollers configured to allow lateral displacements of said horizontal support.

33. An apparatus as recited in claim 30, wherein said triangular structure comprises a pair of legs rigidly having proximal ends attached to the base level and distal ends fixedly joined to one another to provide a support for said mechanical displacement amplifier.

34. An apparatus as recited in claim 30, wherein said damper assembly is mounted within said triangular structure.

35. An apparatus as recited in claim 19 or 20, wherein said damper assembly is mounted within the gravity frame.

36. An apparatus as recited in claim 19 or 20, wherein said reaction frame comprises:

(a) a housing rigidly attached to the base level;

(b) said housing configured to receive said mechanical displacement amplifier;

(c) a diagonal support member having a distal end configured for attachment to said gravity frame at a selected location;

(d) said diagonal support member having a proximal end configured for attachment to said mechanical displacement amplifier such that displacement of said gravity frame at said location will induce movement of said diagonal support.

37. A seismic isolator configured for attachment between a rigid structure and a flexible structure to dissipate seismic energy, comprising:

(a) means for mechanically amplifying movement of said flexible structure in relation to the position of said rigid structure, said means for mechanically amplifying movement having a mechanical output; and (b) a damper coupled to the mechanical output of said mechanical amplifying means;

(c) wherein the means for mechanically amplifying movement comprises (i) concentric rotating gearset having gears of different diameters;

(ii) a small diameter first gear within set gearset coupled to a first linear coupling member subject to the motion of the flexible structure in relation to rigid structure; and (iii) a large diameter second gear which amplifies the motion received by said first clear and couples to a second linear coupling member which is received by said damper to dissipate mechanical energy.

38. A seismic isolator configured for attachment between a rigid structure and a flexible structure to dissipate seismic energy, comprising:

(a) means for mechanically amplifying movement of said flexible structure in relation to the position of said rigid structure, said means for mechanically amplifying movement having a mechanical output; and (b) a damper coupled to the mechanical output of said means for mechanically amplifying movement;

(c) wherein the means for mechanically amplifying movement comprises (i) a generally concentric rotating gearset having a first gear attached to a larger second gear;

(ii) said first gear being coupled to a first linear coupling member subject to the motion of the flexible structure in relation to the rigid structure;

(iii) said second gear coupled to a second linear coupling member: and (iv) said second linear coupling member configured for attachment to said damper.

39. A seismic isolator as recited in claim 37 or 38, wherein the coupling between the gears and the linear coupling members is provided by rack-pinion coupling.

40. A seismic isolator as recited in claim 37 or 38, wherein the means for mechanically amplifying movement is combined with said damper within a rotating damper assembly, comprising:

(a) a third linear coupling member subject to the relative displacement of the gravity frame in relation to the reaction frame;

(b) a gear-driven propeller coupled to said third linear coupling member and configured to amplify the linear displacement of the third linear coupling member into the rotational motion of said propeller; and (c) a housing filled with viscous fluid surrounding said propeller.

41. A seismic isolator as recited in claim 40, wherein said coupling between said linear coupling member and said gear drive propeller is provided by a rack-pinion coupling.

42. A seismic isolator as recited in claim 41, wherein said third linear coupling member is configured with multiple pinions for driving multiple gear-driven propellers.

43. A seismic isolator as recited in claim 37 or 38, wherein said damper dissipates energy to reduce the motion of the flexible structure.

44. A seismic isolator as recited in claim 37 or 38, wherein said damper comprises a hydraulic damper.

45. A seismic isolator as recited in claim 37 or 38, wherein said damper comprises a friction damper.

46. A seismic isolator as recited in claim 37 or 38, wherein said damper comprises a viscous elastic damper.

47. In a seismic isolator configured for attachment within the frame of a civil structure to direct lateral displacement into a damper mechanism, the improvement comprising;

an apparatus configured for mechanically amplifying the displacement of the civil structure and directing said amplified displacement into a damper assembly;

wherein the mechanical amplification apparatus comprises (i) a rotating gearset having gears of different diameters;

(ii) a small diameter gear within said gearset coupled to a linear coupling member subject to the motion of the flexible structure in relation to rigid structure; and (iii) a large diameter gear within said gearset which amplifies the motion received by said first gear and couples to a linear coupling member which is received by said damper assembly to dissipate mechanical energy.

48. In a seismic isolator configured for attachment within the frame of a civil structure to direct lateral displacement into a damper mechanism the improvement comprising:

an apparatus configured for mechanically amplifying the displacement of the civil structure and directing said amplified displacement into a damper assembly; the mechanical amplification apparatus comprising:

(a) a rotating gearset having gears of different diameters;

(b) a small diameter gear within said gearset coupled to a linear coupling member subject to the motion of a flexible structure in relation to a rigid structure, and (c) a large diameter gear within said gearset which amplifies the motion received by said first gear and couples to a linear coupling member which is received by said damper assembly to dissipate mechanical energy;

wherein the coupling between the gears and the linear coupling members comprise rack and pinion mechanisms.

49. The improvement as recited in claim 47 or 48, further comprising:

(a) a linear coupling member subject to the movement of the civil structure;

(b) a gear-driven propeller coupled to said linear coupling member and configured to amplify the displacement of the linear coupling member into the rotational motion of said propeller; and (c) a housing filled with viscous fluid surrounding said propeller.

* * * * *